US007175493B2

(12) United States Patent
Nishimura et al.

(10) Patent No.: US 7,175,493 B2
(45) Date of Patent: Feb. 13, 2007

(54) PLASMA DISPLAY PANEL AND ITS MANUFACTURING METHOD

(75) Inventors: Masaki Nishimura, Osaka (JP); Koji Akiyama, Osaka (JP); Kanako Miyashita, Osaka (JP); Koji Aoto, Hyogo (JP); Keiji Horikawa, Osaka (JP); Masaaki Yamauchi, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 101 days.

(21) Appl. No.: 11/092,755

(22) Filed: Mar. 30, 2005

(65) Prior Publication Data

US 2005/0168126 A1 Aug. 4, 2005

Related U.S. Application Data

(62) Division of application No. 10/469,767, filed as application No. PCT/JP02/13359 on Dec. 20, 2002, now Pat. No. 7,037,156.

(30) Foreign Application Priority Data

Dec. 25, 2001 (JP) ..... 2001-391451
Dec. 25, 2001 (JP) ..... 2001-391452

(51) Int. Cl.
*H01J 9/00* (2006.01)

(52) U.S. Cl. ..... 445/24; 445/25; 313/582

(58) Field of Classification Search ..... 445/23–25, 445/43, 44

See application file for complete search history.

(56) References Cited

U.S. PATENT DOCUMENTS

| | | | | |
|---|---|---|---|---|
| 3,932,920 | A | 1/1976 | Ernsthausen | |
| 6,236,159 | B1 | 5/2001 | Inoue et al. | |
| 6,554,672 | B2 | 4/2003 | Dunham et al. | |
| 6,712,663 | B2 * | 3/2004 | Jo | 445/24 |
| 6,744,208 | B2 | 6/2004 | Kado et al. | |
| 6,960,309 | B2 * | 11/2005 | Aoki et al. | 252/301.4 R |

FOREIGN PATENT DOCUMENTS

| | | | |
|---|---|---|---|
| JP | 9-245653 | | 9/1997 |
| JP | 10-326572 | A | 12/1998 |
| JP | 10-334816 | A | 12/1998 |
| JP | 11-120920 | | 4/1999 |
| JP | 2001-35372 | A | 2/2001 |
| JP | 2001-135237 | | 5/2001 |
| JP | 2001-222957 | A | 8/2001 |
| JP | 2003-51259 | A | 2/2003 |

* cited by examiner

*Primary Examiner*—Joseph Williams
*Assistant Examiner*—Dalei Dong
(74) *Attorney, Agent, or Firm*—McDermott Will & Emery LLP

(57) ABSTRACT

A plasma display panel capable of realizing improvement in the characteristics thereof, such as lower discharge voltage, more stable discharge, higher luminance, higher efficiency, and longer life. During a step of sealing the periphery of substrates or before this sealing step, impurity gas other then inert gas is adsorbed by phosphor layers. The impurity gas is released into discharge gas and the impurity is added to the discharge gas in a controlled manner while the panel is lit. This method can realize improvement in characteristics, such as lower discharge voltage, higher luminance, higher efficiency, and longer life.

13 Claims, 4 Drawing Sheets

PLASMA DISPLAY PANEL AND ITS MANUFACTURING METHOD

RELATED APPLICATIONS

This application is a divisional of U.S. patent application Ser. No. 10/469,767, filed Sep. 4, 2003, now U.S. Pat. No. 7,037,156 which is a 371 application of PCT/JP02/13359, filed Dec. 20, 2002, and claiming priority of Japanese applications 2001-391451 and 2001-391452, both filed Dec. 25, 2001, and the contents of which are hereby incorporated by reference.

FIELD OF THE INVENTION

The present invention relates to a plasma display panel (hereinafter referred to as a "PDP") employing gas discharge emission that is used as a color television receiver or a display for displaying characters or images. It also relates to a method of manufacturing the PDP.

BACKGROUND OF THE INVENTION

In a PDP, ultraviolet rays generated by gas discharge excite phosphors and cause them to emit light for color display. The PDP is structured so that display cells partitioned by ribs are provided on a substrate thereof, and a phosphor layer is formed on each of the display cells.

The PDPs are roughly classified into an AC type and a DC type in terms of driving methods thereof. Discharge systems thereof include two types, i.e. a surface discharge type and an opposite discharge type. Having higher definition, a larger screen, and simpler manufacturing method, a surface discharge type having a three-electrode structure is mainly used in PDPs. This type of PDPs is structured to have adjacent parallel display electrode pairs on one of substrates, and address electrodes, ribs, and phosphor layers arranged in a direction so as to intersect the display electrodes on the other substrate. This structure can thicken the phosphor layers and thus is suitable for color display using phosphors.

Such a PDP is capable of display data faster than a liquid crystal panel. Additionally, it has a larger angle of field, and higher display quality because it is a self-luminous type, and the size thereof can easily be enlarged. For these reasons, especially such a PDP has been drawing attention recently and finds a wide rage of applications, as a display device in a place many people gather or a display device with which people enjoy images on a large screen at home.

Generally, such a PDP is manufactured by the following steps. First, address electrodes made of silver are formed on a rear glass substrate. On the address electrodes, a visible light reflecting layer made of dielectric glass is formed. On the visible light reflecting layer, glass ribs are formed with a predetermined pitch. After phosphor paste including a red phosphor, a green phosphor, or a blue phosphor is applied to respective spaces sandwiched between these ribs, the phosphors are fired to remove resin components or the like in the paste. Thus, phosphor layers are formed and a rear panel board is provided. Then, low-melting glass paste is applied around the rear panel board as a member for sealing with a front panel board. The panel board with the glass paste is calcined at temperatures of approx. 350° C. to remove resin components or the like in the low-melting glass paste.

Thereafter, a front panel board having display electrodes, a dielectric glass layer, and a protective layer sequentially formed thereon is placed opposite to the rear panel board so that the display electrodes and the address electrodes are orthogonal to one another via ribs. The two panel boards are fired at temperatures of approx. 450° C. and the periphery thereof is sealed by the low-melting glass, i.e. the sealing member. Then, while the panel boards are heated to temperatures of approx. 350° C., the inside of the panel boards is evacuated. After the evacuation is completed, discharge gas is introduced at a predetermined pressure. Thus, a PDP is completed.

In a conventional PDP, a rare gas containing at least xenon (Xe) is used as discharge gas. The most commonly used gas is a discharge gas containing neon (Ne) and a several percent of xenon (Xe) mixed therein. This is a high purity gas having a gas purity ranging from approx. 99.99 to 99.999%.

However, it is extremely difficult to add impurity other than rare gas in a predetermined concentration to discharge gas uniformly in a controlled manner, in order to improve discharge characteristics. The cause is as follows. Phosphor materials and magnesium oxide (MgO) serving as a protective film, which are structural materials of a PDP and in contact with discharge gas, are prone to adsorb a large amount of gas other than inert gas: thus, it is difficult to diffuse impurity gas in discharge gas in a controlled manner. Additionally, when impurity gas is only mixed in discharge gas and introduced into a panel, a large amount of impurity gas is adsorbed in the vicinity of a place where the discharge gas is introduced. This causes variations in the luminance and discharge characteristics of the panel.

Especially, $BaMgAl_{10}O_{17}$:Eu, which is commonly used as a blue phosphor, has problems, as disclosed in the Japanese Patent Unexamined Publication No. 2001-35372: it is prone to adsorb a large amount of $H_2O$ in particular and degrade by heat.

On the other hand, a PDP has a high discharge voltage of approx. 200V. In consideration of the cost of the circuit and the resistance of the panel to voltage, a lower discharge voltage is required. At the same time, more stable discharge, higher luminance, higher efficiency, and longer life are required.

The present invention addresses these problems and aims improvement in the characteristics of a PDP, such as lower discharge voltage, more stable discharge, higher luminance, higher efficiency, and longer life.

DISCLOSURE OF THE INVENTION

In order to attain this object, in the present invention, impurity gas other than inert gas is adsorbed by phosphor layers in a step of sealing the periphery of substrates or before the sealing step, so that the impurity gas is released into discharge gas while a panel is lit. This method allows impurity to be added to discharge gas in a controlled manner. Therefore, this method can provide characteristics more improved than those of a conventional panel, such as lower voltage, higher luminance, higher efficiency, and longer life.

PREFERRED EMBODIMENTS OF THE INVENTION

A PDP and a method of manufacturing the PDP in accordance with an exemplary embodiment of the present invention are described hereinafter with reference to specific examples.

First Exemplary Embodiment

Figure 1:
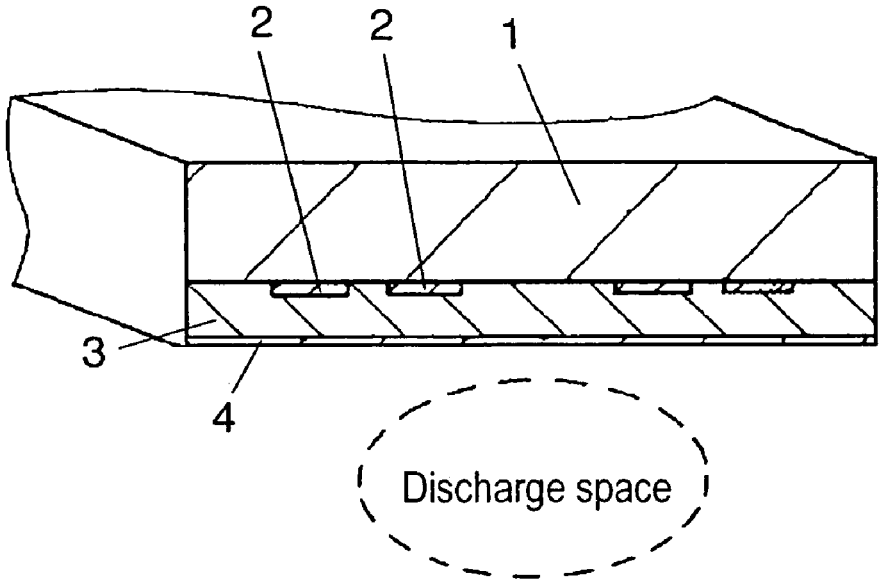
FIG. 1 is a perspective view schematically illustrating a structure of a plasma display panel in accordance with a first exemplary embodiment of the present invention.
Figure 1:
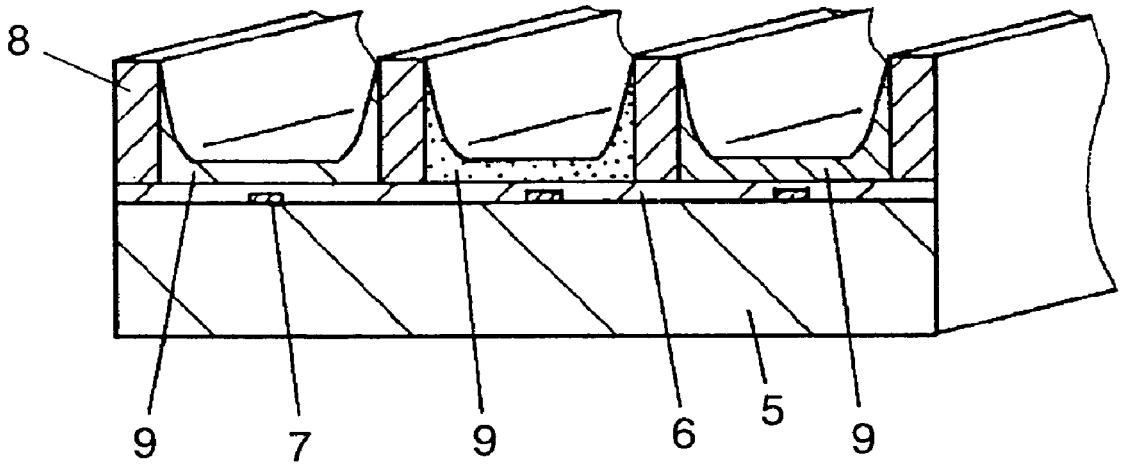

First, a description is provided of the first exemplary embodiment. FIG. 1 illustrates a structure of a PDP of the present invention. As shown in FIG. 1, a plurality of rows of stripe-like display electrodes 2, each made of a pair of a scan electrode and a sustain electrode, are formed on transparent substrate 1 made of material such as glass, on the front side. Dielectric layer 3 made of glass is formed so as to cover the electrodes. Formed on dielectric layer 3 is protective film 4 made of MgO.

On substrate 5 made of material such as glass, on the rear side, which is opposed to substrate 1 on the front side, a plurality of rows of stripe-like address electrodes 7 covered with visible light reflecting layer 6 made of dielectric glass are formed so as to intersect display electrodes 2, i.e. pairs of scan electrodes and sustain electrodes. On visible light reflecting layer 6 between these address electrodes 7, a plurality of ribs 8 are formed in parallel with address electrodes 7. On the side faces of each of these ribs 8 and the surface of visible light reflecting layer 6, phosphor layer 9 is provided.

These substrate 1 and substrate 5 are opposed to each other with a minute discharge space sandwiched therebetween so that display electrodes 2, i.e. pairs of scan electrodes and sustain electrodes, are substantially orthogonal to address electrodes 7. The periphery of these substrates is sealed by sealing member. The discharge space is filled with discharge gas containing at least one of helium, neon, argon, and xenon. The discharge space is divided by ribs 8 into a plurality of partitions. This arrangement provides a plurality of discharge cells each located at the intersection of display electrode 2 and address electrode 7. Each discharge cell has one of red, green, and blue phosphor layers 9 and different color cells are disposed in order.

The above-mentioned red, green, and blue phosphor layers 9 are exited by vacuum ultraviolet rays that have a short wavelength of 147 nm and are generated by discharge, to emit light for color display.

As phosphors constituting phosphor layers 9, the following materials are commonly used.

Blue phosphor: $BaMgAl_{10}O_{17}$:Eu

Green phosphor: $Zn_2SiO_4$:Mn or $BaAl_{12}O_{17}$:Mn

Red phosphor: $Y_2O_3$:Eu or $(Y_xGd_{1-x})BO_3$:Eu

The phosphor of each color is prepared as follows.

As for a blue phosphor ($BaMgAl_{10}O_{17}$:Eu), first, barium carbonate ($BaCO_3$), magnesium carbonate ($MgCO_3$), and aluminum oxide ($\alpha$-$Al_2O_3$) are formulated in an atomic ratio of Ba:Mg:Al=1:1:10. Next, a specific amount of europium oxide ($Eu_2O_3$) is added to this formulation. Then, the mixture is mixed with an appropriate amount of flux agent ($AlF_2$ or $BaCl_2$) using a ball mill. The mixture is fired in a reducing atmosphere ($H_2$—$N_2$), at temperatures ranging from 1,400 to 1,650° C. for a specific period, e.g. 0.5 hour, to provide the blue phosphor.

As for a red phosphor ($Y_2O_3$:Eu), materials, i.e. yttrium hydroxide ($Y_2(OH)_3$) and boric acid ($H_3BO_3$), are formulated in an atomic ratio of Y:B=1:1. Next, a specific amount of europium oxide ($Eu_2O_3$) is added to this formulation. Then, the mixture is mixed with an appropriate amount of flux agent using a ball mill. The mixture is fired in air, at temperatures ranging from 1,200 to 1,450° C. for a specific period, e.g. one hour, to provide the red phosphor.

As for a green phosphor ($Zn_2SiO_4$:Mn), materials, i.e. zinc oxide (ZnO) and silicon oxide ($SiO_2$), are formulated in an atomic ratio of Zn:Si=2:1. Next, a specific amount of manganese oxide ($Mn_2O_3$) is added to this formulation and mixed using a ball mill. The mixture is fired in air, at temperatures ranging from 1,200 to 1,350° C. for a specific period, e.g. 0.5 hour, to provide the green phosphor.

The phosphor particles prepared by the above methods are classified to provide phosphor materials having specific particle-size distribution.

Figure 2:
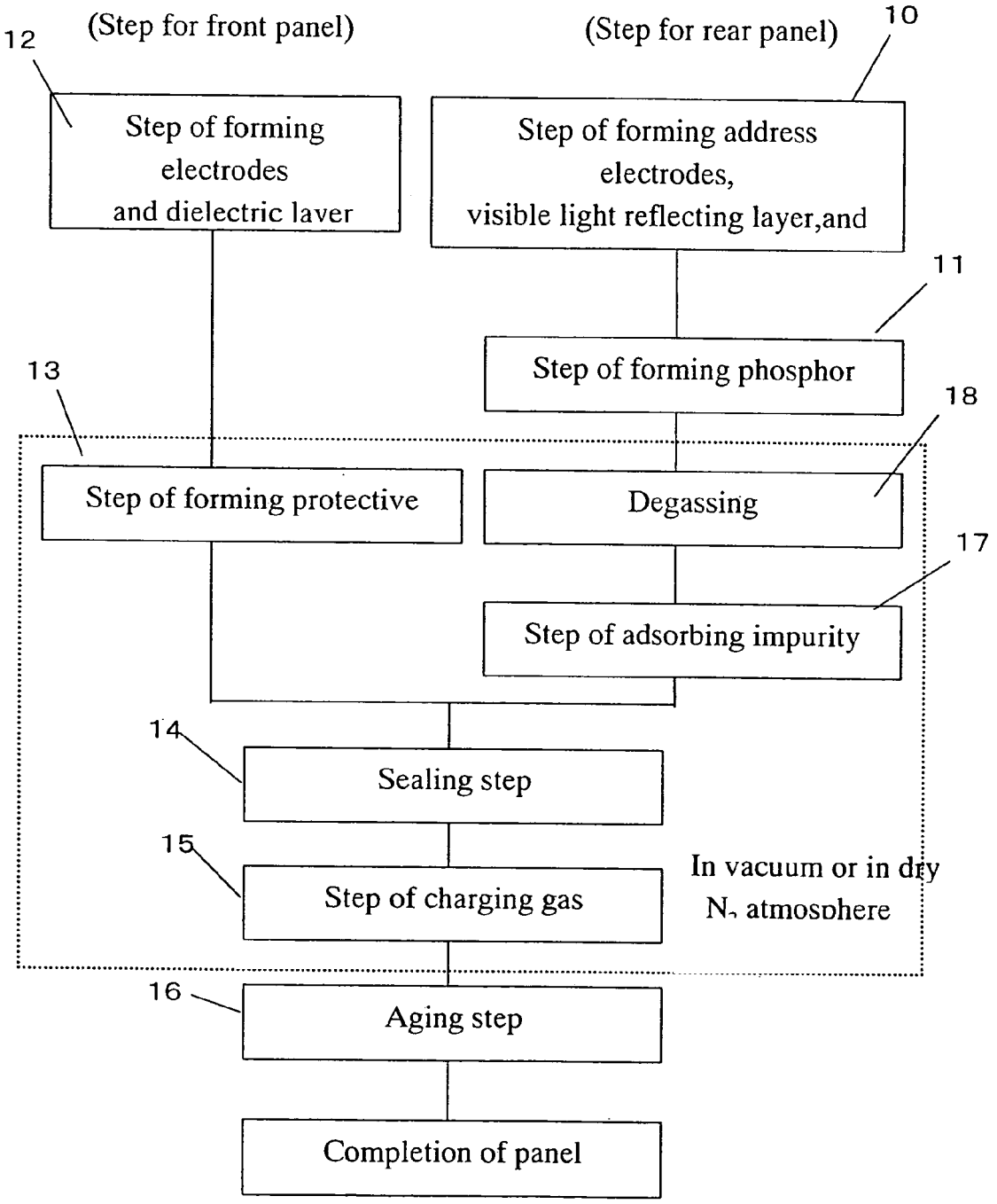
FIG. 2 is a flowchart showing a manufacturing process of the plasma display panel in accordance with the first exemplary embodiment of the present invention.

FIG. 2 shows a manufacturing process of a PDP in accordance with this embodiment. As shown in FIG. 2, on the side of a rear panel board, Step 10 is performed. In Step 10, address electrodes made of silver are formed on a glass substrate, a visible light reflecting layer made of dielectric glass is formed thereon, and glass ribs are formed thereon with a predetermined pitch.

Next, Step 11 of forming phosphors is performed. In Step 11, after phosphor paste including red phosphor, green phosphor, or blue phosphor is applied to each space sandwiched between these ribs, the phosphor paste is fired at temperatures of approx. 500° C. to remove resin components or the like in the paste. Thus, phosphor layers are formed. After formation of the phosphors, a step of forming low-melting glass paste is performed. In this step, low-melting glass paste is applied to the periphery of the rear panel board as a member for sealing with a front panel board, and the rear panel board is calcined at temperatures of approx. 350° C. to remove resin components or the like in the low-melting glass paste.

On the other hand, on the side of a front panel board, Step 12 of forming display electrodes and a dielectric layer on a glass substrate is performed. Then, Step 13 of forming a protective layer is performed.

Thereafter, Step 14 is performed. In Step 14, the front panel board having the display electrodes, dielectric glass layer, and protective layer sequentially formed thereon is disposed opposite to the rear panel board so that the display electrodes and the address electrodes are orthogonal to one another via the ribs, and then, these panel boards are fired at temperatures of approx. 450° C. and the periphery of the panel boards is sealed by the low-melting glass. Performed after Step 14 is Step 15 of evacuating the inside of the sealed panel boards while they are heated to temperatures of approx. 350° C., and then introducing discharge gas at a specific pressure after completion of the evacuation.

Then, a panel is completed by aging step 16 of applying alternating current approx. twice as high as that in normal operation to the display electrodes formed on the glass substrate to cause strong discharge and thus stable discharge.

Now, in this embodiment, impurity gas is adsorbed by phosphor layers during or before the sealing step. In order to limit the impurity gas to be adsorbed, the glass substrates on the front and rear sides are subjected to the steps surrounded by the dotted lines in FIG. 2 in a vacuum up to $10^{-4}$ Pa, or in a dry $N_2$ atmosphere having a dew point up to −60° C. As for the glass substrate on the front side, all the steps from the formation of magnesium oxide, i.e. a protective film, by vacuum electron-beam evaporation to Step 15 of charging sealing gas are performed under the above conditions. As for the glass substrate on the rear side, all the steps after the firing phosphors to Step 15 are performed under the above conditions except for Step 17 of adsorbing impurity gas. The steps before and including the step of firing phosphors on the glass substrate on the rear side are performed in atmospheric air. Thus, before Step 17 of adsorbing impurity gas, the panel board is heated at a temperature of 500° C. in a vacuum to remove gas adsorbed in the atmospheric air (Step 18). Step 17 of adsorbing impurity gas is performed by introducing desired impurity gas containing at least one of $H_2O$ and $CO_2$ and exposing the panel board to the gas until room temperature is reached during a temperature-lowing sub-step in Step 18 of degassing.

As discussed above, MgO and phosphor materials, especially a blue phosphor, existing in the discharge space in a PDP are prone to adsorb a large amount of impurity gas other than inert gas. The impurity gas causes variations in the luminance and discharge characteristics of the panel. In order to address such a problem, adsorption of impurity gas should be prevented. However, practically, the structure of a PDP makes it difficult to prevent adsorption of impurity gas.

Then, the inventors have conducted various experiments and discussions to determine if controlling the adsorption of impurity gas can improve and stabilize the characteristics of a PDP. As a result, the inventors have found the present invention in which a step of adsorbing impurity gas is provided to control the amount of impurity gas to be adsorbed.

Figure 3:
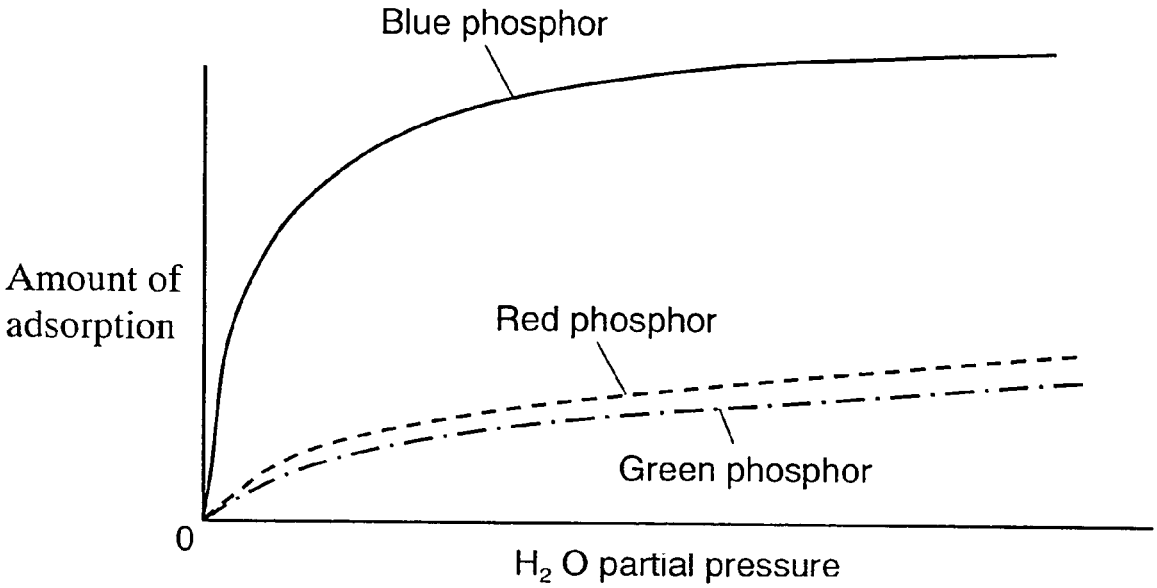
FIG. 3 is a graph showing an amount of impurity gas adsorbed by each phosphor with respect to $H_2O$ partial pressures in a step of adsorbing the impurity gas.

FIG. 3 is a graph showing the results of experiments the inventors have conducted to determine how phosphors adsorb impurity gas containing $H_2O$. As shown in FIG. 3, it has been found that the amount of $H_2O$ adsorbed by the phosphor of each color is correlated with the partial pressure of $H_2O$, in a step of adsorbing impurity gas. In other words, the characteristics in FIG. 3 show that a blue phosphor adsorbs the largest amount of $H_2O$ and considerably varies with the partial pressure of $H_2O$ in the step of adsorbing impurity gas. This proves that the total amount of $H_2O$ in the inside space of a PDP can be controlled by controlling the amount of $H_2O$ adsorbed by a blue phosphor.

In other words, providing a step of adsorbing impurity gas before the sealing step to cause impurity gas other than inert gas to be adsorbed by phosphor layers allows uniform introduction of impurity gas other than inert gas onto the surface of a panel board in a controlled manner. According to the inventors' experiments, it is sufficient to introduce a gas containing at least one of $H_2O$ and $CO_2$ as this impurity gas. The effects of the impurity gas can realize lower discharge voltage, more stable discharge, higher luminance, higher efficiency, and longer life of a PDP.

Now, a description is provided of the reason why adsorption of impurity gas by phosphors can control discharge characteristics. In general, the method of driving a PDP is made of initializing discharge, addressing discharge, and sustaining discharge. The driving principle is as follows. In the first initializing discharge, application of a large voltage has an effect of resetting the inside of discharge cells. Next, according to the signals of an image to be displayed, addressing discharge is selectively given only in cells to be lit. The discharge is sustained by sustaining discharge. Gradation is expressed using the number of pulses of this sustaining discharge. At this time, during the initializing discharge and addressing discharge, discharge occurs between the display electrodes formed on the front panel board and the address electrodes formed on the rear panel board. For this reason, it is considered, if impurity gas is adsorbed by the phosphors formed on the address electrodes on the rear panel board, the impurity gas is effectively released into the discharge gas by the initializing discharge and addressing discharge. Because phosphor materials are likely to adsorb a large amount of gas other than inert gas, it is considered that the impurity gas once released into the discharge gas is adsorbed by the phosphor materials again after the completion of sustaining discharge. This is considered a factor of why adding impurity gas to discharge gas in a controlled manner can effectively control discharge characteristics.

In this embodiment, impurity gas is adsorbed by phosphors by exposing a rear panel board having the phosphors formed thereon to gas containing the desired impurity gas between a step of firing the phosphors and a sealing step. However, impurity gas can be adsorbed by phosphors and the effects same as those of this embodiment can be obtained by performing the sealing step in an atmosphere containing desired impurity gas, or supplying a flow of gas containing desired impurity gas into the inside space formed by the front and rear panel boards during the sealing step.

According to the inventors' experiments, the effects of the present invention discussed above show the following correlation. The molecularity of $CO_2$ at its peak at temperatures ranging from 0 to 500° C. and the molecularity of $H_2O$ at its peak at temperatures of at least 300° C. are correlated with each other in a temperature-programmed desorption mass spectrometry (TDS) of these impurity gases.

Described next is experimental results of gas atmospheres in a step of adsorbing impurity gas, and the amount of impurity gas adsorbed by a blue phosphor after completion of a panel. Table 1 shows the results. In Table 1, terms in the respective columns have the following meanings.

Lighting voltage: sustaining voltage required to light the entire surface of a panel.

Discharge failure: the number of discharge failures in 1,000 times of addressing discharge. When this number is large, unlit cells degrade picture quality.

Voltage margin: voltage difference between a lighting voltage required to light the panel and a voltage at which lighting failure occurs, when the sustaining voltage is increased from the lighting voltage. When this value is larger, more stable driving can be provided.

Voltage margin after lighting: voltage margin after discharge at a sustaining voltage of 200 kHz for 500 hours.

Variations in margin: Variations in voltage margin before and after discharge at a sustaining voltage of 200 kHz for 500 hours are shown in voltage (V).

Relative luminance: Relative intensity is shown with the value of panel No. 1 set to 100. Table 1 gives actual numerical values and evaluations of the numerical values indicated by marks ◎, ○, Δ, and X (◎: excellent, ○: no problem in practical level, Δ: improvement needed in practical level but no problem, X: having problem in practical level).

TABLE 1

| Panel No. | Impurity gas adsorption atmosphere | Amount of released peak $H_2O$ at temperatures of at least 300° C. ($\times 10^{15}$/g) | Amount of released peak $CO_2$ at temperatures ranging from 100 to 600° C. ($\times 10^{14}$/g) | Lighting voltage (V) | | Discharge failure (Number of times) | | Voltage margin (V) | | Voltage margin after lighting (V) | | Variations in margin (V) | | Relative luminance | |
|---|---|---|---|---|---|---|---|---|---|---|---|---|---|---|---|
| 1 | Vacuum | 1.3 | 0.1 | 175 | ○ | 20 | ○ | 55 | ◎ | 55 | ◎ | 0 | ◎ | 100 | ○ |
| 2 | Dry $N_2$ | 1.4 | 3.6 | 174 | ○ | 18 | ○ | 55 | ◎ | 55 | ◎ | 0 | ◎ | 101 | ○ |
| 3 | Dry $N_2$, $CO_2$(0.1%) | 1.6 | 9.2 | 174 | ○ | 10 | ○ | 38 | ○ | 35 | ○ | −3 | ◎ | 99 | ○ |
| 4 | Dry $N_2$, $CO_2$(1%) | 1.7 | 16.3 | 175 | ○ | 9 | ◎ | 18 | X | 15 | X | −3 | ◎ | 90 | X |
| 5 | Dry $N_2$, $CO_2$(0.1%), $H_2O$(3 Torr) | 3.8 | 9.5 | 170 | ◎ | 7 | ◎ | 39 | ○ | 34 | ○ | −5 | ○ | 105 | ◎ |
| 6 | Dry $N_2$, $CO_2$(0.1%), $H_2O$(30 Torr) | 7.0 | 9.6 | 168 | ◎ | 8 | ◎ | 35 | ○ | 15 | X | −20 | X | 104 | ◎ |
| 7 | Dry $N_2$, $H_2O$(3 Torr) | 3.6 | 3.5 | 169 | ◎ | 17 | ○ | 38 | ○ | 33 | ○ | −5 | ○ | 100 | ○ |
| 8 | Atmospheric air | 26.5 | 18.2 | 170 | ◎ | 7 | ◎ | 32 | ○ | 7 | X | −25 | X | 95 | Δ |

As obvious from this Table 1, for each of Panel No. 1 fabricated in a vacuum and Panel No. 2 fabricated in a dry $N_2$ atmosphere, the phosphors adsorb an extremely small amount of $H_2O$ and $CO_2$, the initial voltage margin is extremely large, the margin exhibits almost no variations, and thus stable discharge can be realized for a long period of time. In contrast, for each of Panels No. 3 and No. 4 subjected to impurity gas adsorption, the number of discharge failures is smaller than those of Panels No. 1 and Panel No. 2. This shows adsorption of $CO_2$ can reduce discharge failures. However, on the other hand, for Panel No. 4 fabricated in a $CO_2$ (1%) atmosphere, the initial voltage margin is small and luminance degradation is seen at the same time. Further, the inventors have also confirmed that this serious luminance degradation occurs when the molecularity of adsorbed $CO_2$ at its peak at temperatures up to 500° C. exceeds $1\times10^{15}$/g.

Therefore, the number of discharge failures can be reduced without causing serious luminance degradation by causing phosphors to adsorb $CO_2$ in an amount of a peak molecularity at temperatures up to 500° C. ranging from $1\times10^{13}$/g to $1\times10^{15}$/g.

Panel No. 5 fabricated in a $N_2$ atmosphere with 0.1% of $CO_2$ and 3 Torr of $H_2O$ in partial pressure added thereto, and Panel No. 6 fabricated in a $N_2$ atmosphere with 0.1% of $CO_2$ and 30 Torr of $H_2O$ added thereto are compared with Panel No. 3 fabricated in a $N_2$ atmosphere with only $CO_2$ (0.1%) added thereto. For each of Panels No. 5 and No. 6, a large decrease in voltage margin is not seen, and the effects of decrease in lighting voltage and improvement in luminance can be obtained. However, for Panel No. 6 fabricated in an atmosphere with $H_2O$ (30 Torr) added thereto, variations in margin are large, and thus stable discharge for a long period of time is difficult. The inventors of the present invention have confirmed that the variations in margin increase and the voltage margin decreases when the molecularity of $H_2O$ adsorbed by phosphors at its peak is $5\times10^{15}$/g or more.

Therefore, setting the amount of $H_2O$ adsorbed by phosphors to a peak molecularity at temperatures of at least 300° C. ranging from $1\times10^{15}$/g to $5\times10^{16}$/g can reduce discharge voltage without causing a large decrease in voltage margin. This allows stable discharge at high luminance for a long period of time and a decrease in discharge voltage.

In this embodiment, it has been confirmed that adsorption of both $CO_2$ and $H_2O$ provides the effects of individual adsorbed gases and improvement in luminance, which is not seen when $CO_2$ or $H_2O$ is adsorbed separately as impurity gas. This means that factors of luminance degradation caused by $CO_2$ are inhibited by $H_2O$. It is considered that the $CO_2$ adsorption site in a phosphor that causes luminance degradation adsorbs $H_2O$ and this $H_2O$ adsorption reduces luminance degradation. At the same time, it is also considered that the decrease in discharge voltage increases the ultraviolet radiation efficiency of Xe. Additionally, the inventors of the present invention have confirmed that the synergistic effect of inhibiting $CO_2$ luminance degradation and improving luminance caused by this $H_2O$ is largely related to the ratio of the molecularity of peak $CO_2$ and the molecularity of peak $H_2O$. The inventors have found it is preferable that the ratio of the molecularity of peak $H_2O$ to the molecularity of peak $CO_2$ ranges from 3.7 to 4.3 and the synergistic effect is most effective at a ratio of approx. 4.0.

Now, the number of adsorbed molecules X (/g) is determined by the following equation:

$$X=\{N/(R\times T)\}P\times S\times t\times(J/I)/W=2.471\times10^{20}\times P\times S\times t\times(J/I)/W$$

where, in a temperature-programmed desorption mass spectrometry (TDS), an evacuation speed is set S ($m^3$/s), an interval of measuring time to t(s), all ionic current detected to I(A), ionic current of a molecule to be determined to J(A), a pressure at detection of current to P(Pa), a weight of a measuring sample to W(g), a gas constant to R, a temperature to T, and the Avogadro's number to N. Used in this embodiment is data at an evacuation speed of 0.19 ($m^3$/s) and an interval of measuring time of 15 (s).

As discussed above, the present invention allows uniform introduction of impurity gas other than inert gas onto the surface of a panel board in a controlled manner. Additionally, by introduction of both $H_2O$ and $CO_2$ as impurity gases, the effects of respective impurity gases can realize improvement in the characteristics of a PDP, such as lower discharge voltage, more stable discharge, higher luminance, higher efficiency, and longer life.

Second Exemplary Embodiment

Next, the second exemplary embodiment is described.

In the second exemplary embodiment, impurity gas containing at least $CH_4$ is adsorbed by phosphor layers during or before the sealing step. Similar to the first exemplary embodiment, the impurity gas to be adsorbed is limited. For this purpose, glass substrates on front and rear sides are subjected to the steps surrounded by the dotted lines in FIG. 2 in a vacuum up to $10^{-4}$ Pa, or in a dry $N_2$ atmosphere having a dew point up to −60° C. As for the glass substrate on the front side, all the steps from the formation of magnesium oxide, i.e. a protective film, by vacuum electron-beam evaporation to Step 15 of charging sealing gas are performed under the above conditions. As for the glass substrate on the rear side, all the steps after the firing phosphors to Step 15 are performed under the above conditions except for Step 17 of adsorbing impurity gas. The steps before and including the step of firing phosphors on the glass substrate on the rear side are performed in atmospheric air. Thus, before Step 17 of adsorbing impurity gas, the panel board is heated at a temperature of 600° C. in a vacuum to remove gas adsorbed in the atmospheric air (Step 18). Step 17 of adsorbing impurity gas is performed by introducing desired impurity gas containing at least one of $H_2O$ and $CH_4$ and exposing the panel board to the gas until room temperature is reached during a temperature-lowing sub-step in Step 18 of degassing.

This second exemplary embodiment is based on the finding that the molecularity of $CH_2$ at its peak seen at temperatures ranging from 0 to 600° C. and the molecularity of $H_2O$ at its peak seen at temperatures of at least 300° C. are correlated with each other in a temperature-programmed desorption mass spectrometry (TDS) of these impurity gases. As described hereinafter, the second exemplary embodiment has effects similar to those of the first exemplary embodiment.

In the TDS, methane-containing hydrocarbon with a larger mass number represented by $C_nH_{2n+2}$, i.e. a polymer of CH-containing impurity, and ethylene-containing hydrocarbon represented by $C_nH_{2n}$ are also detected. However, the amount of adsorbed $CH_2$ is highly correlated with discharge characteristics. This is because molecules having a smaller mass number are likely to have the largest effect on discharge. $CH_4$ and O have the same mass number. Thus, in the TDS, O releases ions disturbing the evaluation of the amount of adsorbed $CH_4$ and measurement of $CH_4$ adsorption is difficult. For this reason, $CH_2$ adsorption is used as an index of $CH_4$ adsorption.

Described next is experimental results of gas atmospheres in a step of adsorbing impurity gas, and the amount of impurity gas adsorbed by a blue phosphor after completion of a panel. Table 2 shows the results. In Table 2, terms in the respective columns have the meanings same as those of Table 1 and the description of these terms is omitted.

As obvious from this Table 2, for each of Panel No. 1 fabricated in a vacuum and Panel No. 2 fabricated in a dry $N_2$ atmosphere, the phosphors adsorb an extremely small amount of $H_2O$ and $CH_4$, the initial voltage margin is extremely large, the margin exhibits almost no variations, and thus stable discharge can be realized for a long period of time. In contrast, for each of Panels No. 3 and No. 4 subjected to impurity gas adsorption, the number of discharge failures is smaller than those of Panels No. 1 and Panel No. 2. However, on the other hand, for Panel No. 4 fabricated in a $CH_4$ (1%) atmosphere, a decrease in voltage margin and luminance degradation are seen at the same time. Further, the inventors have also confirmed that this serious luminance degradation occurs when the molecularity of adsorbed $CH_2$ at its peak at temperatures ranging from 100 to 600° C. exceeds $2\times10^{15}$/g.

Therefore, the number of discharge failures can be reduced without causing serious luminance degradation by causing phosphors to adsorb $CH_2$ in an amount of a peak molecularity at temperatures from 100 to 600° C. ranging from $0.5\times10^{14}$/g to $3.0\times10^{14}$/g.

TABLE 2

| Panel No. | Impurity gas adsorption atmosphere | Amount of released peak $H_2O$ at temperatures of at least 300° C. ($\times10^{15}$/g) | Amount of released peak $CH_2$ at temperatures ranging from 100 to 500° C. ($\times10^{14}$/g) | Ratio of amount of released peak $CH_2$ to amount of released peak $H_2O$ | Lighting voltage (V) | | Discharge failure (Number of times) | | Voltage margin (V) | | Voltage margin after lighting (V) | | Variations in margin (V) | | Relative luminance | |
|---|---|---|---|---|---|---|---|---|---|---|---|---|---|---|---|---|
| 1 | Vacuum | 1.3 | 0.1 | 0.008 | 175 | ○ | 20 | ○ | 55 | ◎ | 55 | ◎ | 0 | ◎ | 100 | ○ |
| 2 | Dry $N_2$ | 1.4 | 0.1 | 0.007 | 174 | ○ | 18 | ○ | 55 | ◎ | 55 | ◎ | 0 | ◎ | 101 | ○ |
| 3 | Dry $N_2$, $CH_4$(0.1%) | 1.6 | 0.8 | 0.050 | 174 | ○ | 10 | ○ | 38 | ○ | 35 | ○ | −3 | ◎ | 99 | ○ |
| 4 | Dry $N_2$, $CH_4$(1%) | 1.7 | 5.0 | 0.294 | 175 | ○ | 9 | ◎ | 18 | 5 | 15 | 5 | −3 | ◎ | 90 | 5 |
| 5 | Dry $N_2$, $CH_4$(0.1%), $H_2O$(3 Torr) | 3.8 | 1.2 | 0.032 | 170 | ◎ | 7 | ◎ | 39 | ○ | 34 | ○ | −5 | ○ | 105 | ◎ |
| 6 | Dry $N_2$, $CH_4$(0.1%), $H_2O$(30 Torr) | 7.0 | 1.5 | 0.021 | 168 | ◎ | 8 | ◎ | 35 | ○ | 15 | 5 | −20 | 5 | 104 | ◎ |
| 7 | Dry $N_2$, $H_2O$(3 Torr) | 3.6 | 0.1 | 0.003 | 169 | ◎ | 17 | ○ | 38 | ○ | 33 | ○ | −5 | ○ | 100 | ○ |
| 8 | Atmospheric air | 26.5 | 4.0 | 0.015 | 170 | ◎ | 7 | ◎ | 32 | ○ | 7 | 5 | −25 | 5 | 95 | Δ |

Panel No. 5 fabricated in a $N_2$ atmosphere with 0.1% of $CH_4$ and 3 Torr of $H_2O$ in partial pressure added thereto, and Panel No. 6 fabricated in a $N_2$ atmosphere with 0.1% of $CH_4$ and 30 Torr of $H_2O$ added thereto are compared with Panel No. 3 fabricated in a $N_2$ atmosphere with only $CH_4$ (0.1%) added thereto. For each of Panels No. 5 and No. 6, a large decrease in voltage margin is not seen, and the effects of decrease in lighting voltage and improvement in luminance can be obtained. However, for Panel No. 6 fabricated in an atmosphere with $H_2O$ (30 Torr) added thereto, the margin after lighting largely decreases, and thus stable discharge for a long period of time is difficult.

The inventors of the present invention have confirmed that the voltage margin after lighting further decreases, when the molecularity of $H_2O$ adsorbed by phosphors at its peak appearing at temperatures of at least 300° C. is $5\times10^{15}$/g or more.

Therefore, setting the amount of $H_2O$ adsorbed by phosphors to a peak molecularity appearing at temperatures of at least 300° C. ranging from $1\times10^{15}$/g to $5\times10^{16}$/g can reduce discharge voltage without causing a large decrease in voltage margin. This allows stable discharge at high luminance for a long period of time and a decrease in discharge voltage.

Figure 4:
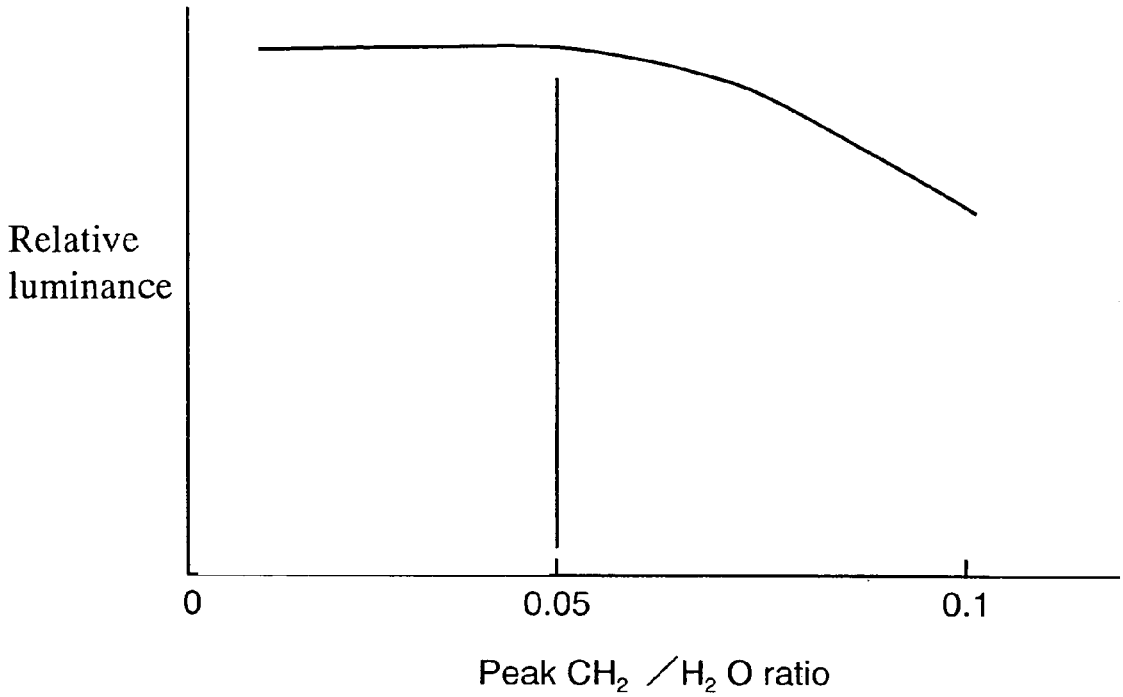
FIG. 4 is a graph showing a relation between ratios of $CH_2$ peak molecularity to $H_2O$ peak molecularity and luminance.

In this embodiment, it has been confirmed that adsorption of both $CH_4$ and $H_2O$ provides the effects of individual adsorbed gases and improvement in luminance, which is not seen when $CH_4$ or $H_2O$ is adsorbed separately as impurity gas. This means that the factors of luminance degradation caused by $CH_4$ are inhibited by $H_2O$. It is considered that the $CH_4$ adsorption site in a phosphor that causes luminance degradation adsorbs $H_2O$ and this $H_2O$ adsorption reduces luminance degradation. At the same time, it is also considered that the decrease in discharge voltage increases the ultraviolet radiation efficiency of Xe. The inventors of the present invention have confirmed that the synergistic effect of inhibiting $CH_4$ luminance degradation and improving luminance caused by this $H_2O$ is largely related to the ratio of the molecularity of peak $CH_2$, i.e. an index of $CH_4$ adsorption, appearing at temperatures ranging from 100 to 600° C. and the molecularity of peak $H_2O$ appearing at temperatures of at least 300° C. As shown in FIG. 4, the synergistic effect is especially effective when the ratio of the molecularity of peak $CH_2$ appearing at temperatures ranging from 100 to 600° C. to the molecularity of peak $H_2O$ appearing at temperatures of at least 300° C. is up to 0.05. In contrast, when the ration is 0.05 or larger, the luminance decreases.

When the molecularity of peak $H_2O$ appearing at temperatures of at least 300° C. is $5\times10^{15}$/g or more, the gradient of the decrease in luminance at the adsorption ratio of 0.05 or larger is gentle. However, when the molecularity of peak $H_2O$ appearing at temperatures of at least 300° C. is up to $5\times10^{15}$/g, the gradient of the decrease in luminance is prone to be sharper as the ratio increases.

As discusses above, it is most desirable that the molecularity of peak $H_2O$ appearing at temperatures of at least 300° C. is up to $5\times10^{15}$/g and the adsorption ratio is up to 0.05, in order to increase luminance without decreasing voltage margin.

FIG. 4 shows the relation between luminance and the ratio of the molecularity of desorbed peak $CH_2$ appearing at temperatures ranging from 100 to 600° C. to the molecularity of desorbed peak $H_2O$ appearing at temperatures of at least 300° C., in the results of a temperature-programmed desorption mass spectrometry (TDS) of the amount of adsorbed $H_2O$.

As discussed above, in the present invention, both $H_2O$ and $CH_4$ are introduced as impurity gases. The effects of respective gases can realize improvement in the characteristics of a PDP, such as lower discharge voltage, more stable discharge, higher luminance, higher efficiency, and longer life.

In the above description, $BaMaAl_{10}O_{17}$:Eu is used as an example of a blue phosphor. When a aluminate represented by $(Ba_{1-m}Sr_m)_iMgAl_jO_n$:$Eu_k$, where $0\leqq m\leqq0.25$, $1.0i\leqq1.8$, $12.7\leqq j\leqq21.0$, $0.01\leqq k\leqq0.20$ and $21.0\leqq n\leqq34.5$ is used, characteristics of adsorbing $H_2O$ thereof approximate to those of red and green phosphors. This provides an advantage: the adsorption of impurity gas can be controlled more easily.

INDUSTRIAL APPLICABILITY

As discussed above, the present invention allows uniform introduction of impurity gas other than inert gas onto the surface of a panel board in a controlled manner. The effects of the impurity gas can realize improvement in the characteristics of a PDP, such as lower discharge voltage, more stable discharge, higher luminance, higher efficiency, and longer life.

The invention claimed is:

1. A plasma display panel in which a pair of substrates are opposed so as to form a space therebetween, a periphery of the substrates are sealed by a sealing member, electrodes are disposed on the substrates so that discharge occurs in the space, and a phosphor layer for emitting light by discharge is provided, wherein the phosphor layer has a blue phosphor, and an amount of $H_2O$ adsorbed by the blue phosphor is such that a molecularity of desorbed $H_2O$ at a peak thereof appearing in a region of temperatures of at least 300° C. in a temperature-programmed desorption mass spectrometry is up to $5\times10^{15}$/g.

2. The plasma display panel of claim 1, wherein the amount of $H_2O$ adsorbed by the blue phosphor is such that the molecularity of desorbed $H_2O$ at the peak thereof appearing in the region of temperatures of at least 300° C. in the temperature-programmed desorption mass spectrometry ranges from $1\times10^{15}$/g to $5\times10^{15}$/g.

3. A plasma display panel in which a pair of substrates are opposed so as to form a space therebetween, a periphery of the substrates are sealed by a sealing member, electrodes are disposed on the substrates so that discharge occurs in the space, and a phosphor layer for emitting light by discharge is provided, wherein the phosphor layer has a blue phosphor, and an amount of $CO_2$ adsorbed by the blue phosphor is such that a molecularity of desorbed $CO_2$ at a peak thereof appearing in a region of temperatures ranging from 0 to 500° C. in a temperature-programmed desorption mass spectrometry is up to $1\times10^{15}$/g.

4. The plasma display panel of claim 3, wherein the amount of $CO_2$ adsorbed by the blue phosphor is such that the molecularity of desorbed $CO_2$ at the peak thereof appearing in the region of temperatures ranging from 0 to 500° C. in the temperature-programmed desorption mass spectrometry ranges from $1\times10^{13}$/g to $1\times10^{15}$/g.

5. A plasma display panel in which a pair of substrates are opposed so as to form a space therebetween, a periphery of the substrates are sealed by a sealing member, electrodes are disposed on the substrates so that discharge occurs in the space, and a phosphor layer for emitting light by discharge is provided, wherein the phosphor layer has a blue phosphor, an amount of $H_2O$ adsorbed by the blue phosphor is such that a molecularity of desorbed $H_2O$ at a peak thereof appearing in a region of temperatures of at least 300° C. ranges from $1\times10^{15}$/g to $5\times10^{15}$/g, and an amount of $CO_2$ adsorbed by the blue phosphor is such that a molecularity of desorbed $CO_2$ at a peak thereof appearing in a region of temperatures ranging from 0 to 500° C. ranges from $1\times10^{13}$/g to $1\times10^{15}$/g in a temperature-programmed desorption mass spectrometry.

6. A plasma display panel in which a pair of substrates are opposed so as to form a space therebetween, a periphery of the substrates are sealed by a sealing member, electrodes are disposed on the substrates so that discharge occurs in the space, and a phosphor layer for emitting light by discharge is provided, wherein the phosphor layer has a blue phosphor, an amount of $H_2O$ adsorbed by the blue phosphor is such that a molecularity of desorbed $H_2O$ at a peak thereof appearing in a region of temperatures of at least 300° C. is 3.7 to 4.3 times a molecularity of desorbed $CO_2$ at a peak thereof appearing in a region of temperatures ranging from 0 to 500° C. in a temperature-programmed desorption mass spectrometry.

7. The plasma display panel of claim 6, wherein the amount of $H_2O$ adsorbed by the blue phosphor is such that the molecularity of desorbed $H_2O$ at the peak thereof appearing in the region of temperatures of at least 300° C. is 3.9 to 4.1 times the molecularity of desorbed $CO_2$ at the peak thereof appearing in the region of temperatures ranging from 0 to 500° C. in the temperature-programmed desorption mass spectrometry.

8. A plasma display panel in which a pair of substrates are opposed so as to form a space therebetween, a periphery of the substrates are sealed by a sealing member, electrodes are disposed on the substrates so that discharge occurs in the space, and a phosphor layer for emitting light by discharge is provided, wherein the phosphor layer has a blue phosphor, and an amount of $CH_4$ adsorbed by the blue phosphor is such that a molecularity of desorbed $CH_2$ at a peak thereof appearing in a region of temperatures ranging from 100 to 600° C. in a temperature-programmed desorption mass spectrometry is up to $3.0\times10^{14}$/g.

9. The plasma display panel of claim 8, wherein the amount of $CH_4$ adsorbed by the blue phosphor is such that the molecularity of desorbed $CH_2$ at the peak thereof appearing in the region of temperatures ranging from 100 to 600° C. in the temperature-programmed desorption mass spectrometry ranges from $0.5\times10^{14}$/g to $3.0\times10^{14}$/g.

10. A plasma display panel in which a pair of substrates are opposed so as to form a space therebetween, a periphery of the substrates are sealed by a sealing member, electrodes are disposed on the substrates so that discharge occurs in the space, and a phosphor layer for emitting light by discharge is provided, wherein the phosphor layer has a blue phosphor, an amount of $H_2O$ adsorbed by the blue phosphor is such that a molecularity of desorbed $H_2O$ at a peak thereof appearing in a region of temperatures of at least 300° C. in a temperature-programmed desorption mass spectrometry ranges from $1\times10^{15}$/g to $5\times10^{15}$/g, and an amount of $CH_4$ adsorbed by the blue phosphor is such that a molecularity of desorbed $CH_2$ at a peak thereof appearing in a region of temperatures ranging from 100 to 600° C. in the temperature-programmed desorption mass spectrometry ranges from $0.5\times10^{14}$/g to $3.0\times10^{14}$/g.

11. A plasma display panel in which a pair of substrates are opposed so as to form a space therebetween, a periphery of the substrates are sealed by a sealing member, electrodes are disposed on the substrates so that discharge occurs in the space, and a phosphor layer for emitting light by discharge is provided, wherein the phosphor layer has a blue phosphor, an amount of $H_2O$ adsorbed by the blue phosphor is such that a ratio of a molecularity of desorbed $CH_2$ at a peak thereof appearing in a region of temperatures ranging from 100 to 600° C. to a molecularity of desorbed $H_2O$ at a peak thereof appearing in a region of temperatures of at least 300° C. in a temperature-programmed desorption mass spectrometry is up to 0.05.

12. A plasma display panel in which a pair of substrates are opposed so as to form a space therebetween, a periphery of the substrates are sealed by a sealing member, electrodes are disposed on the substrates so that discharge occurs in the space, and a phosphor layer for emitting light by discharge is provided, wherein the phosphor layer has a blue phosphor, an amount of $H_2O$ adsorbed by the blue phosphor is such that a molecularity of desorbed $H_2O$ at a peak thereof appearing in a region of temperatures of at least 300° C. in a temperature-programmed desorption mass spectrometry ranges from $1\times10^{15}$/g to $5\times10^{15}$/g, and the amount of $H_2O$ adsorbed by the blue phosphor is such that a ratio of a molecularity of desorbed $CH_2$ at a peak thereof appearing in a region of temperatures ranging from 100 to 600° C. to the molecularity of desorbed $H_2O$ at the peak thereof appearing in the region of temperatures of at least 300° C. in the temperature-programmed desorption mass spectrometry is up to 0.05.

13. The plasma display panel of any one of claims 1 through 12, wherein the blue phosphor is made of an aluminate represented by $(Ba_{1-m}Sr_m)iMgAl_jO_n:Eu_k$.

* * * * *